United States Patent [19]

Williams, Jr.

[11] 4,058,435

[45] Nov. 15, 1977

[54] SEAL ASSEMBLY FOR PRESSURE OR VACUUM CHAMBERS

[75] Inventor: Glenn V. Williams, Jr., Monroe, Ohio

[73] Assignee: Diamond International Corporation, New York, N.Y.

[21] Appl. No.: 705,435

[22] Filed: July 15, 1976

[51] Int. Cl.[2] ..... D21F 3/10

[52] U.S. Cl. ..... 162/371; 162/370

[58] Field of Search ..... 162/371, 370

[56] References Cited

U.S. PATENT DOCUMENTS 3,802,961 4/1974 Grass et al. ..... 162/371

*Primary Examiner*—S. Leon Bashore

*Assistant Examiner*—Richard V. Fisher

*Attorney, Agent, or Firm*—Karl W. Flocks

[57] ABSTRACT

Improvements in seal assembly for use in pressure or vacuum chambers or the like comprising a sealing element which may be selectively placed in sealing condition or retracted to a non-sealing condition, the sealing element having a sealing surface adapted to be urged into contact with a wall member and also a surface including portions against load members which may be loaded to urge the sealing surface into sealing condition or relaxed, and spring unit for continuously urging the sealing element away from sealing condition whereby the sealing element is in fact urged out of sealing condition when the load members are relaxed.

12 Claims, 6 Drawing Figures

SEAL ASSEMBLY FOR PRESSURE OR VACUUM CHAMBERS

BACKGROUND OF THE INVENTION

1. Field of the Invention

In the prior art devices rolls having rotatable, perforated or cellular structure outer elements with an internal system for creating a sub-atmospheric pressure or vacuum within this rotatable outer element, are used for various purposes; such as, dewatering a moving, moist web of paper; applying greater traction for pulling a moving web of paper, metal or other materials; and picking up web or transferring sheet, an operation required in conjunction with certain printing presses. To produce stationary vacuum zones inside the roll, a suitable chamber connected to an external pump or exhauster must be provided, and in order to control the area in which vacuum is applied, as well as to assure optimum operating efficiency of the vacuum system, sealing arrangements must be provided to close off the line of contact between the inside of the rotating, perforated shell of the roll and the internally mounted stationary chamber. Presently a known practice is to mount rectangularly shaped pieces of non-metallic material having a low coefficient of friction and good wear qualities in a U-shaped member in such a manner that it can be radially forced outwardly against the internal surface of the rotating shell by springs or an inflatable air pressure tube. Of necessity, operating clearances must be provided between the non-metallic sealing element and the channel of the U-shaped holder in which it is disposed. In many applications of vacuum rolls certain parts thereof are exposed to contaminating environments, such as acids, adhesives or the like. Also, solid materials can become deposited in the clearances between the seal element and the U-shaped holder so that continuous free movement of the seal element becomes very difficult to maintain as the seal element is forced past the solid materials that are accumulated. As a result, the seal will become locked in a depressed position corresponding to the least internal radius of the rotating shell, and if there is any eccentricity in the bore of the shell, a clearance will occur when the shell is rotated to any other position and leakage past the seal will occur. In some applications of vacuum rolls, this can cause a fluctuation of the desired internal subatmospheric pressure in the roll with consequential adverse effect on the required function of the roll. Further, continued contact of the sealing element with the roll surface prevents proper cleaning thereof and subjects the sealing element and/or rotating shell to possible corrosion. Such prior art deficiencies have been approached with the teachings of U.S. Pat. No. 3,802,961 of Grass et al with considerable success.

SUMMARY OF THE INVENTION

The present invention provides a new and improved construction of a sealing assembly to improve the useful life of devices of this type known heretofore.

Another advantage of the present invention resides in the provision of a seal assembly having a lower radial profile than the prior art devices of this type whereby less bulk is encountered in the manufacture, installation and operation of the sealing assembly.

It is an object of the present invention to provide an improved sealing assembly which may be selectively placed into sealing condition or retracted from sealing condition to improve the useful life of the assembly.

It is moreover an object of the present invention to extend the period between replacement and/or servicing of seal assemblies of this type.

DETAILED DESCRIPTION OF THE INVENTION

Figure 2:
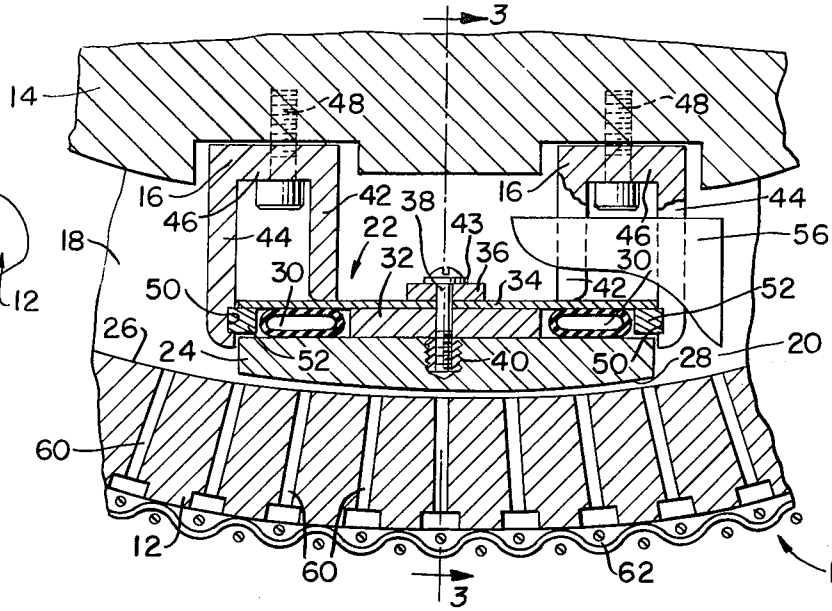
FIG. 2 is a sectional view taken along line 2—2 of FIG. 1 to show details of the sealing assembly with the sealing element retracted to a non-sealing condition.
Figure 1:
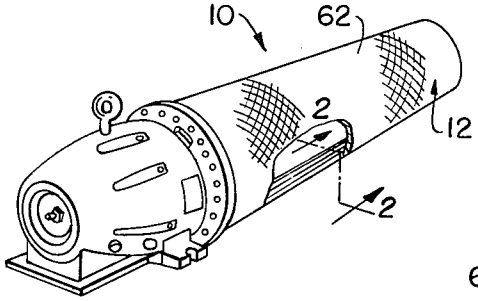
FIG. 1 is a view in perspective of a vacuum roll in which the seal assembly according to the present invention is incorporated.

Referring now in detail to the drawings, and in particular to FIGS. 1–6, the novel sealing arrangement according to this invention is seen to be incorporated in a vacuum roll assembly 10 which includes a perforated rotating outer shell 12 and a stationary inner portion 14 on which support members 16 are secured. Within the interior of the vacuum roll assembly 10 separate vacuum chambers 18 and 20 may be formed between a plurality of sealing assemblies 22. Shell 12, for example, may be formed with a plurality of perforations 60 to transmit suction to the outer surface over which extends a wire screen 62.

Each sealing arrangement 22 comprises a longitudinally extending sealing element 24 adapted to be selectively urged into sealing condition or retracted from sealing condition with respect to the inner surface 26 of roll 12. The sealing element 24 may be made from a material having a low coefficient of friction, such as polyethylene. Sealing surface 28 of sealing element is arcuate and is complementary with inner surface 26 of roll 12. Sealing element 24 as seen in FIG. 2 includes a generally flat radially inner surface along which are disposed a pair of inflatable loading tubes 30 with a spacer member 32 therebetween and a generally flat spring unit such as a resilient plate or leaf 34 of spring material overlying tubes 30 and spacer member 32 and extending laterally beyond the expanse of tubes 30. While sealing element 24 and spacer member 32 are illustrated as separate members, they may be, and in actual practice, have been combined as one integral member. A clamping bar 36 or the like extends over plate 34 with a plurality of bolts 38 each of which extends radially through bar 36, plate 34, spacer 32 and in threaded engagement with sleeve 40. Sleeve 40 provides a stable assembly in that it has male threads which provide a secure connection to sealing element 24 and female threads which provide a secure clamping of the assembled parts of sealing assembly 22. Because of the use of threaded sleeves 40, there is no necessity for an elongate pressure plate or the formation of an elongate slot therefor in the sealing element as required in the construction in the cited U.S. Pat. No. 3,802,961. Consequently, the sealing element 24 of the present application is sturdier than its predecessor since less material is removed to accommodate sleeves 40.

Figure 3:
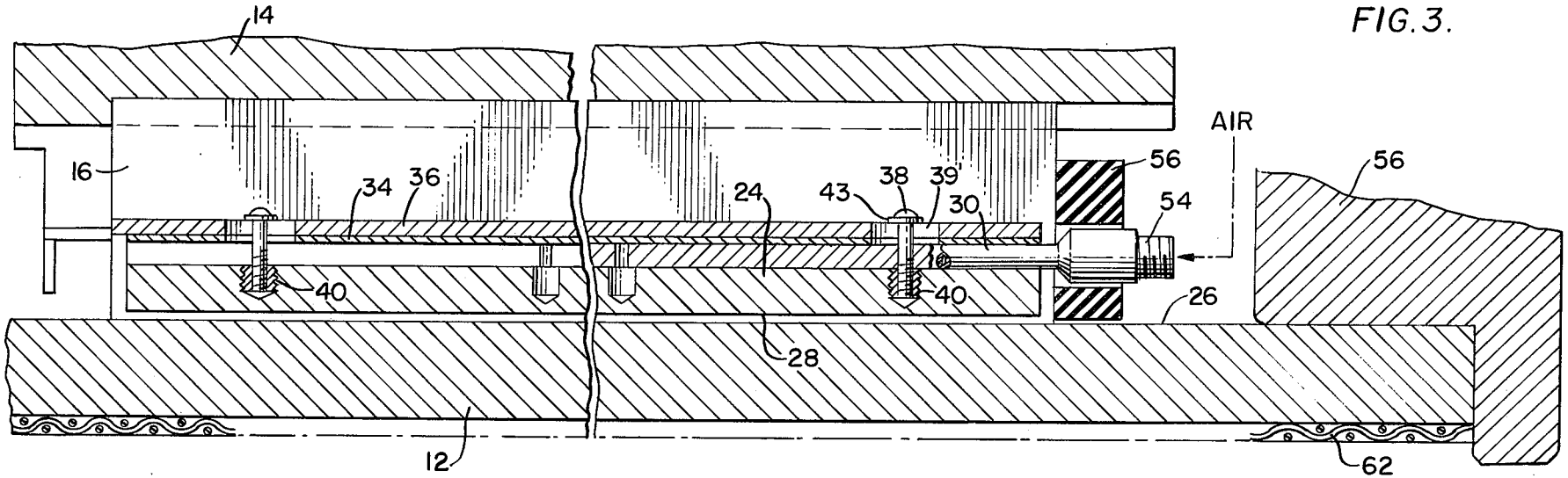
FIG. 3 is a section taken along line 3—3 in FIG. 2.

Each support member 16 extends longitudinally of vacuum roll 10 is channel shaped and includes pair of spaced apart generally radially extending legs 42, 44 which are connected together by generally circumferentially extending bight portion 46, which is secured by bolts 48 to inner portion 14 of roll assembly 10. The leg 42 of each support member 16 is disposed over sealing assembly 22 with its radially outer edge in abutment against plate 34. It is noted that radially outer edge of leg 42 is rounded on one side to merge with a vertical edge to minimize resistance to deflection of plate 34. Leg 44 of each support member 16 is longer than leg 42, extends past opposite sides of plate 34, and is formed with a longitudinally extending groove 50 in which is secured a rest pad or bar 52 extending between plate 34 and sealing element 24 alongside one of the tubes 30 in space provided by spacer member 32. As seen in FIG. 2, opposite edges of plate 34 are resting on top of rest pad or bar 52 in the retracted condition of sealing element 24. At one end of inflatable tube 30 there is provided an air inlet-outlet port 54 equipped with a valve for optionally allowing inflation or deflation of tube 30. As seen in FIG. 3 port 54 extends through a cover plate 56.

Figure 6:
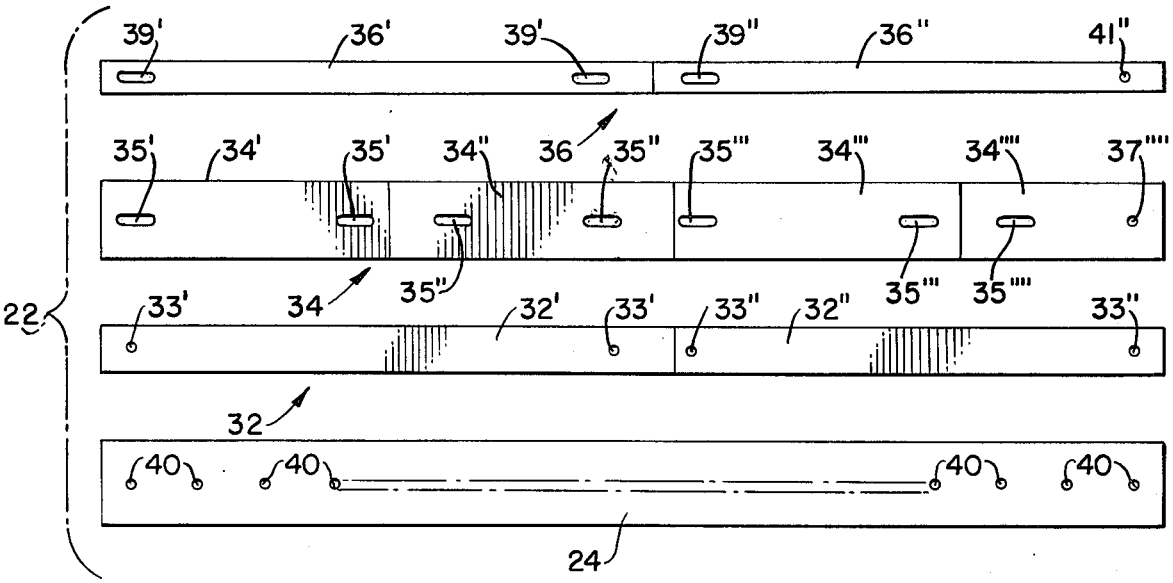

In at least one installation actually in use, sealing element 24, which is formed as a molded member, is up to as much as 184 inches in length and in another installation it is about 231 inches in length and may be of other lengths as governed by the length of the roll assembly 10. Because sealing element 24 is so long, the spacer member 32, resilient plate 34 and clamping bar 36 may each be assembled together from separate pieces as illustrated in FIG. 6. To facilitate assembly of the various parts into sealing assembly 22, sealing element 24 is provided with a plurality of threaded sleeves 40; spacer member 32 which includes two pieces 32', 32'' provided with through holes 33', 33'' for alignment with some sleeves 40; resilient plate 34 which includes several pieces 34', 34'', 34''', 34'''' provided with slots 35', 35'', 35''', 35'''' and/or hole 37'''' for alignment with some sleeves 40; and clamping bar 36 which includes two pieces 36', 36'' provided with slots 39', 39'''' or hole 41'' for alignment with some sleeves 40. The slots 35', 35'', 35''', 35'''', 39', 39'' are provided to allow for expansion or contraction of the various pieces due to flexure of the sealing assembly 22 under loaded conditions, for example. In assembling the various pieces to form sealing assembly 22 use of washer 43 over each slot 39' of clamping bar 36' and over slot 39'' and hole 41'' of clamping bar 36'' would ensure against damage to the pieces from bolts 38.

OPERATION OF THE INVENTION

Prior to or after operation of the vacuum roll assembly 10 air is released from port 54 of tube 30 whereupon resilient plate 34 assumes the position in FIGS. 2 and 3 which holds sealing assembly 22 in retracted condition with sealing surface 28 of sealing element 24 away from the inner surface 26 of shell 12 so that chambers 18 and 20 are equalized in pressure. In this retracted condition of sealing assembly 22, deleterious materials on the inner surface 26 of shell 12 and also on sealing element 24 may be cleaned and removed. Also, because of the retractability of sealing assembly, any tendency of solidification between sealing element 24 with the inner surface 26 of shell 12 through drying of resinous products would be avoided.

Figure 4:
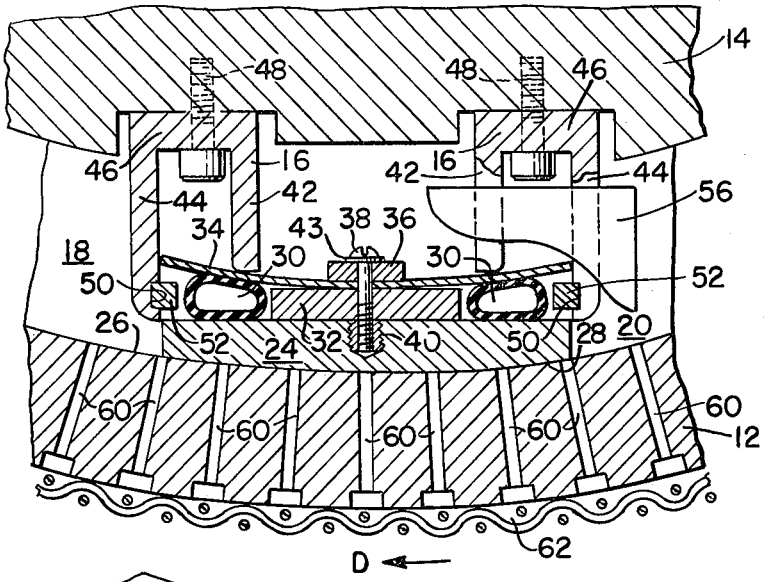
FIG. 4 is a view similar to FIG. 2 with the sealing element urged into sealing condition.
Figure 5:
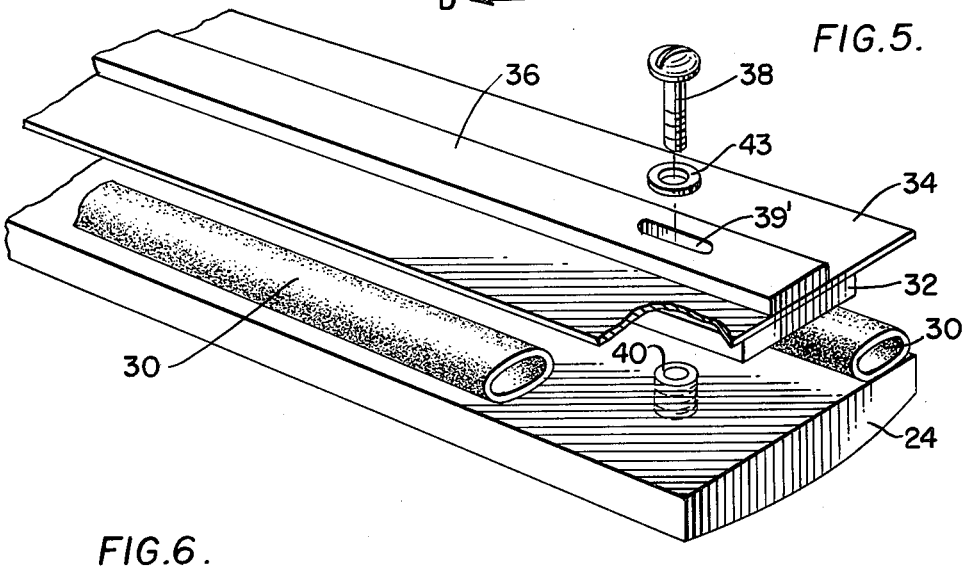
FIG. 5 shows an exploded fragmentary view in perspective of the sealing assembly of FIGS. 2–4 and FIG. 6 shows a plan view of a plurality of the parts of the sealing assembly laid out for inspection.

To isolate chambers 18 and 20 from each other so that different pressures or vacuums may be imposed therein, it is necessary to urge sealing assembly 22 outwardly radially so that sealing surface 28 is in contact with inner surface 26 of shell 12; this condition is obtained by inflating tubes 30 by the introduction of compressed air through port 54. Upon introduction of sufficient air into tubes 30 sealing surface 28 of sealing elements 24 will assume the contact position with inner surface 26 of shell 12 as seen in FIG. 4 wherein chambers 18 and 20 are isolated from each other. It is seen that with tubes 30 inflated opposite edges of resilient plate 34 will be deflected or lifted off rest pads 52 by tubes 30 until further deflection of plate 34 is resisted by the radial outer edge of legs 42 support members 16 so that sealing element 24 is moved radially outwardly into sealing contact with shell 12. Deflection of plate 34 around legs 42 is facilitated by the rounded side of the outer edge. Deflection of plate 34 actually starts on opposite sides of clamping bar 36 as seen in FIG. 4. Upon placing sealing element 24 into contact with inner surface 26 of shell 12, shell 26 is ready for operation to rotate, for example, in the direction of arrow D.

From the foregoing description a new and improved sealing assembly is provided and disclosed for use in isolating pressure and/or vacuum chambers in roll devices.

It will be obvious to those skilled in the art that various changes may be made without departing from the scope of the invention and the invention is not to be considered limited to what is shown in the drawings and described in the specification.

What is claimed is:

1. Seal assembly for use in forming a zone or chamber in which pressure or vacuum may be applied in the interior of a vacuum roll such as is used in the manufacture of paper comprising:

a. a generally elongate sealing element having an arcuate sealing surface conforming generally in curvature to that of the interior of the roll in which it is to be incorporated;

b. a generally flat spring unit disposed radially inwardly of said sealing element and being substantially equal to said sealing element in axial length and in circumferential width;

c. loading means disposed between said sealing element and said spring unit to selectively apply a load for urging said sealing element away from said spring unit to a sealing condition; and d. means securing said sealing element and said spring unit together with said loading means therebetween and said spring unit urging said sealing element toward a non-sealing position.

2. Seal assembly as defined in claim 1 wherein said loading means comprise at least one inflatable tubular member including means for selectively inflating and deflating said tubular member and wherein said tubular member may be loaded to sealing condition beyond the urging of said spring unit.

3. Seal assembly as defined in claim 2 wherein said loading means comprise a pair of said inflatable tubular members extending between said spring unit and said sealing element for the length thereof with spacer means extending between said tubular members and between a surface of said sealing element radially inwardly from said arcuate sealing surface and said spring unit.

4. Seal assembly as defined in claim 3 wherein said securing means comprise a clamping bar unit disposed radially inwardly of said spring unit, threaded members disposed in said sealing element and bolt members extending through said clamping bar unit, said spring unit, said spacer means and in threaded relationship with said threaded members.

5. Seal assembly as defined in claim 4 wherein said sealing element is of low coefficient of friction material.

6. Seal assembly as defined in claim 4 wherein said sealing element is of polyethylene.

7. Seal assembly as defined in claim 6 wherein said threaded members include male threads in threaded engagement with said sealing element and female threads in threaded engagement with said bolt members.

8. Sealing assembly as defined in claim 4 wherein said spring unit is formed from a plurality of plate springs disposed in end-to-end relationship with each of said plate springs having at least one hole through which at least one of said bolt members extends in assembly.

9. Sealing assembly as defined in claim 8 wherein said clamping bar unit and said spacer means are each formed from a plurality of sections disposed in end-to-end relationship with each of said sections having at least one hole through which at least one of said bolt members extends in assembly.

10. Sealing assembly as defined in claim 9 wherein at least some of said holes in said plate springs, and in said sections of clamping bar unit and said spacer means are in the form of slots to allow for axial movement or expansion.

11. Sealing assembly as defined in claim 10 incorporated in a roll provided with a pair of circumferentially spaced, axially extending mounting members, each of said mounting members including a pair of radially extending legs of which a radially longer leg is provided with an axially extending ledge with said spring unit being radially inwardly of said ledge and resting thereon and a radially shorter leg having a free end disposed radially inwardly of said spring unit and providing a reaction point against radial inward movement of said spring unit when said tubular members are inflated so that said sealing element is urged radially outwardly to sealing condition.

12. Sealing assembly as defined in claim 2 wherein said loading means comprise a pair of said inflatable tubular members disposed between said spring unit and said sealing element for the length thereof.

* * * * *